US007178638B2

(12) United States Patent
Fujita et al.

(10) Patent No.: US 7,178,638 B2
(45) Date of Patent: Feb. 20, 2007

(54) CAR DOOR APPARATUS OF ELEVATOR

(75) Inventors: Yoshiaki Fujita, Fuchu (JP); Kenzo Tonoki, Tokyo (JP); Norihito Togashi, Yokohama (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/219,887

(22) Filed: Sep. 7, 2005

(65) Prior Publication Data

US 2006/0175143 A1 Aug. 10, 2006

Related U.S. Application Data

(63) Continuation of application No. PCT/JP2004/008565, filed on Jun. 11, 2004.

(51) Int. Cl.
*B66B 13/02* (2006.01)
*B66B 13/06* (2006.01)
*E05D 15/06* (2006.01)

(52) U.S. Cl. ..... 187/333; 187/313; 187/334; 187/335; 49/231

(58) Field of Classification Search ..... 187/313, 187/314, 316, 331, 335; 49/118–120, 141, 49/370, 409–411
See application file for complete search history.

(56) References Cited

U.S. PATENT DOCUMENTS 3,051,281 A * 8/1962 Huff, Jr. ..... 49/8
3,074,124 A * 1/1963 Bergstedt ..... 49/231
4,436,184 A * 3/1984 Dorman et al. ..... 187/331
4,646,471 A * 3/1987 Shaiu ..... 49/231
5,165,142 A * 11/1992 Pilsbury ..... 16/90
5,305,855 A * 4/1994 Rivera et al. ..... 187/334
5,347,755 A * 9/1994 Jaster et al. ..... 49/25
5,655,627 A * 8/1997 Horne et al. ..... 187/335
5,857,290 A * 1/1999 Schnarr ..... 49/138
5,894,911 A * 4/1999 Bozorgzadeh et al. ..... 187/335
5,899,303 A * 5/1999 Allen ..... 187/333
5,918,705 A * 7/1999 Friend ..... 187/335
6,098,341 A * 8/2000 Gebauer ..... 49/226
6,330,763 B1 * 12/2001 Kern et al. ..... 49/231
6,360,487 B1 * 3/2002 Kern et al. ..... 49/231
2004/0256181 A1 * 12/2004 Durand et al. ..... 187/316

FOREIGN PATENT DOCUMENTS

FR 2830245 A1 * 4/2003

(Continued)

*Primary Examiner*—Kathy Matecki
*Assistant Examiner*—Eric E. Pico
(74) *Attorney, Agent, or Firm*—Oblon, Spivak, McClelland, Maier & Neustadt, P.C.

(57) ABSTRACT

A car door apparatus of an elevator includes a pair of door panels, a door drive device, and a door-opening mechanism. The pair of door panels open and close a doorway of the car of the elevator. The door drive device drives the door panels to open and close the doorway using electric power. When the car is stopped in an emergency in which a power source for driving the elevator is shut off, the door-opening mechanism starts up the door drive device using a secondary battery to move the door panels in the opening direction by a predetermined distance respectively to make a predetermined clearance between the door panels.

10 Claims, 7 Drawing Sheets

FOREIGN PATENT DOCUMENTS

| | | | | |
|---|---|---|---|---|
| JP | 54-33241 | | | 10/1979 |
| JP | 55-151484 | | | 11/1980 |
| JP | 1-303286 | | | 12/1989 |
| JP | 6-171873 | | | 6/1994 |
| JP | 11-503992 | | | 4/1999 |
| JP | 2004-10286 | | | 1/2004 |
| JP | 2004010286 | A | * | 1/2004 |
| WO | WO 3104129 | A1 | * | 12/2003 |

* cited by examiner

CAR DOOR APPARATUS OF ELEVATOR

CROSS REFERENCE TO RELATED APPLICATIONS

This is a Continuation Application of PCT Application No. PCT/JP2004/008565, filed Jun. 11, 2004, which was published under PCT Article 21(2) in Japanese.

BACKGROUND OF THE INVENTION

1. Field of the Invention

The present invention relates to a car door apparatus that is installed to a car of an elevator, and particularly, to the air ventilation structure of a car having airtightness in emergency situations.

2. Description of the Related Art

A car of an elevator moves upward and downward inside the elevator shaft of a building with passengers accommodated therein. Passengers inside the car come to feel annoyed with a change of air pressure during the upward and downward movement when the difference of running elevation goes beyond 300 meters. Furthermore, the passengers begin to be affected physiologically in auditory organs when the elevating speed becomes significantly high.

So as to suppress the affection, in an elevator, a car may be sometimes provided with an air pressure control device for controlling and adjusting air pressure inside the car. In this case, the car includes a pressurization blower that compresses air and sends thus compressed air to pressurize the inside of the car, and a exhaust blower that exhausts air to decompress the inside of the car, which function as the air pressure control device. When the pressurization blower and the exhaust blower are arbitrarily driven, air pressure inside the car is adjusted depending on the changing of external air pressure.

The car provided with such an air pressure control device is required to have a high airtightness therein. However, when the airtightness of a car is increased, there is a problem in a case the car is stopped in an emergency with passengers confined in it, causing a power source for driving the elevator to be shut off due to electric power failure, etc.

When a car is supplied with power, the pressurization blower and the exhaust blower of the air pressure control device may ventilate the car. However, if the car is stopped in an emergency when the air pressure control device cannot be driven in a case that the power source is shut off due to electric power failure, etc., the car cannot be ventilated. Accordingly, the density of oxygen in the car becomes thin, which not only makes passengers feel uncomfortable but may also result in a serious problem regarding safety when the situation continues for a long time.

BRIEF DESCRIPTION OF THE INVENTION

A present invention provides a car door apparatus of an elevator that can automatically open a door panel of a car within a range assuring safety so as to ventilate the car when the car is stopped in an emergency causing a power source for driving the elevator to be shut off due to electric power failure, etc.

A car door apparatus of an elevator includes a door panel, a door drive device, and a door-opening mechanism. The door panel opens and closes a doorway of a car of the elevator. The door drive device drives the door panel using electric power to open and close the door panel. When the car is stopped in an emergency causing the electric power for driving the elevator to be shut off, the door-opening mechanism starts up the door drive device by a secondary battery to move the door panel in the direction of opening door by a predetermined distance.

A car door apparatus of an elevator includes a pair of door panels, a door drive device, and a door-opening mechanism. The pair of door panels open and close a doorway of a car of the elevator. The door drive device drives the door panels using electric power to open and close the door panels. When the car is stopped in an emergency causing electric power for driving the elevator to be shut off, the door-opening mechanism starts up the door drive device by a secondary battery to move the door panels in the direction of opening door by a predetermined distance respectively to make a predetermined clearance between the door panels.

The door panels slide along door rails arranged at the car. The door rails have lower steps and upper steps divided by slopes. The lower steps are formed at the middle portion of the door rails. The door panels in the closed state go to climb over the slopes to move from the lower step sections to the upper step sections to be the opened state. The force to drive door in the door-opening mechanism is set to be smaller than the force required when the door panels climb over the slopes.

It is desired that the width of the clearance between the door panels opened by the door-opening mechanism be set to be between 50 millimeters to 200 millimeters.

The car door apparatus of the elevator further includes a limiting device that prevents the door panels from moving in the opening direction beyond a predetermined distance when the door panels move the predetermined distance in the opening direction by the door-opening mechanism.

The limiting device has a restriction pin, an electromagnetic actuator and an urging member. The restriction pin can move vertically. The electromagnetic actuator drives the restriction pin. The urging member urges the restriction pin downward. The restriction pin is attracted upward when the electromagnetic actuator is supplied with power, and is descent by its own weight and urging force of the urging member when the electromagnetic actuator is not supplied with power. The restriction pin limits the moving range of the door panels at this lower position.

When the door panels are driven by the door drive device, the electromagnetic actuator of the limiting device is supplied with power. Since the restriction pin is attracted upward to be held in the upper position, the limitation for moving of the door panels is released.

DETAILED DESCRIPTION OF THE INVENTION

The present invention will be described below with reference to the accompanying drawings.

Figure 1A:
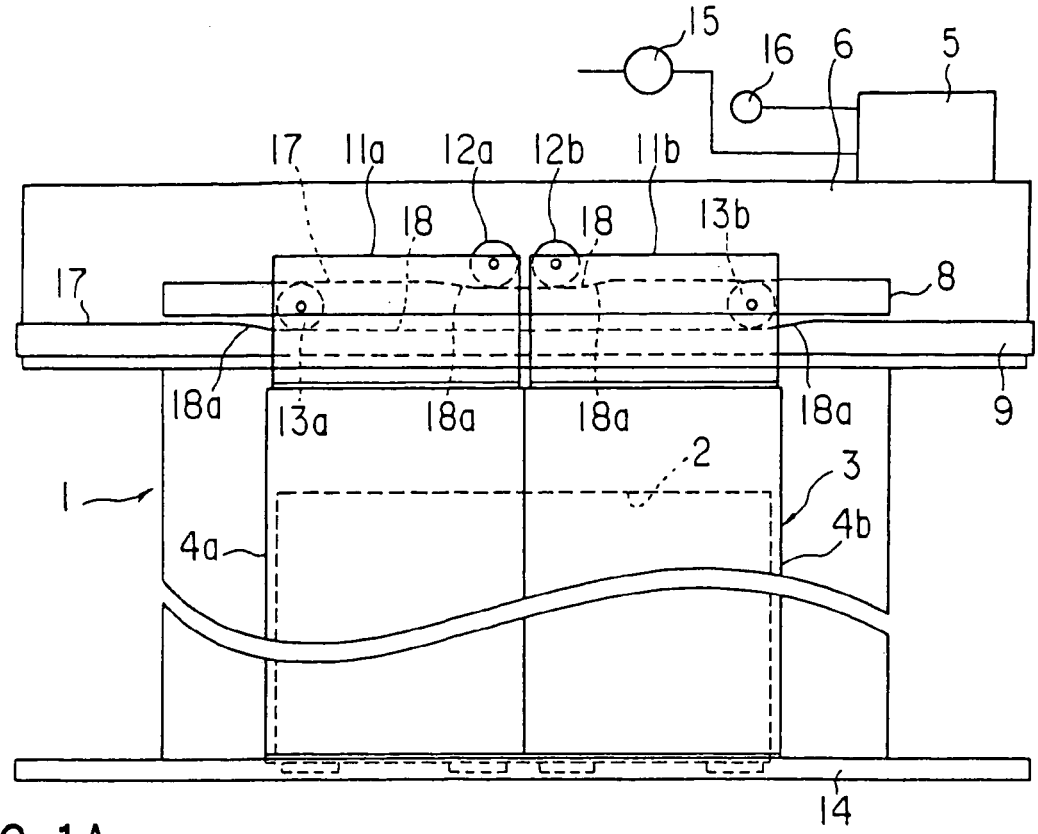
FIG. 1A is a front view of a car door apparatus of an elevator of the first embodiment according to the present invention that is viewed from the elevator hall side, in which the car door apparatus is closed.
Figure 1B:
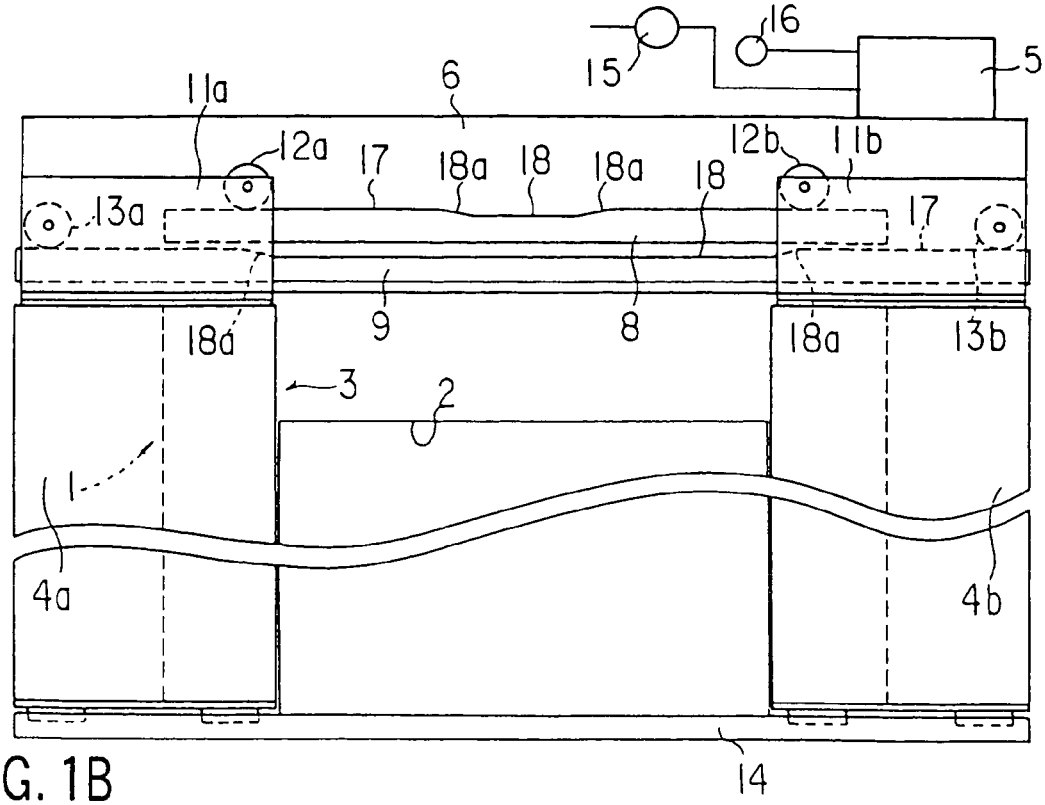
FIG. 1B is a front view of the car door apparatus shown in FIG. 1A, in which the car door apparatus is opened.

A car door apparatus 3 shown in FIGS. 1A and 1B includes a pair of door panels 4*a* and 4*b* of the biparting type door. These door panels 4*a* and 4*b* are slid rightward and leftward when being driven by a door drive device 5 so as to open and close a doorway 2.

A support plate 6 is attached to the front upper portion of a car 1. At the front portion of the support plate 6, a first door rail 8 and a second door rail 9 are arranged in parallel with their positions made different from each other along the upward and downward direction as well as backward and forward direction.

The door panels 4*a* and 4*b* are provided with hangers 11*a* and 11*b* that face the support plate 6 on the upper edge portion, respectively. Inside these hangers 11*a* and 11*b*, hanger rollers 12*a*, 13*a*, 12*b* and 13*b* are rotatably attached with their positions made different from each other along the upward and downward direction, rightward and leftward direction, and backward and forward direction.

The hanger rollers 12*a* and 12*b* are so placed on the first door rail 8 as to be able to roll thereon. The hanger rollers 13*a* and 13*b* are so placed on the second door rail 9 as to be able to roll thereon. The door panels 4*a* and 4*b* are movably suspended under the lower portion of the support plate 6 such that the door panels 4*a* and 4*b* can move along the door rails 8 and 9. Furthermore, at the front lower portion of the car 1, there is arranged a doorsill 14 that supports the lower portion of the respective door panels 4*a* and 4*b* to guide shifting of the door panels 4*a* and 4*b*.

On the upper edge portion of the first and second door rails 8 and 9, there are formed rolling paths 17 on which the hanger rollers 12*a*, 12*b*, 13*a* and 13*b* roll. Shallow recesses 18 are formed at the middle portions of the rolling paths 17, extending along predetermined distances. Slopes 18*a* are formed at both ends of the recesses 18 along the longitudinal direction.

The door rails 8 and 9 have steps which are defined by the slopes 18*a*. The lower step areas configure the recesses 18.

In case of the closed state in which the car 1 is shut with the edges of the door panels 4*a* and 4*b* made to abut with each other, the hanger rollers 12*a*, 12*b*, 13*a* and 13*b* are located in the areas of the recesses 18 formed on the door rails 8 and 9, as shown in FIG. 1A.

When the door panels 4*a* and 4*b* are driven by the door drive device 5 from this state, and are made to move rightward and leftward about 40 millimeters respectively, that is, when there is made a clearance of about 80 millimeters between the opening door panels 4*a* and 4*b*, the hanger rollers 12*a*, 12*b*, 13*a* and 13*b* arrive at the slopes 18*a* located at both ends of the recesses 18, respectively. When the door panels 4*a* and 4*b* are made to move further, the hanger rollers 12*a*, 12*b*, 13*a* and 13*b* climb over the slopes 18*a* to go to the upper step sections.

An ordinary power source 15 that is a commercial power source for driving the elevator as well as a secondary battery 16 as an emergency power source are connected to the door drive device 5. The door drive device 5 is generally supplied with power from the ordinary power source 15. When an electric power failure occurs, the electric power failure is detected and the power supply line is automatically switched to that of the secondary battery 16. The door drive device 5 is supplied with power from the secondary battery 16 at the time of electric power failure.

There is arranged a limiting device 30 on the front upper portion of the car 1, as shown in FIGS. 2 to 5. In FIGS. 1A and 1B, the limiting device 30 is omitted.

The limiting device 30 has a frame 31 attached to the support plate 6. The frame 31 is provided with an electromagnetic actuator 32. The frame 31 has a level support base 35 and a level edge plate 36. A restriction pin 37 is so arranged as to pass through the support base 35 and edge plate 36. The upper end portion of the restriction pin 37 is linked to a plunger 38 that is driven by the electromagnetic actuator 32.

At the middle portion of the restriction pin 37, there is arranged a flange member 40. A spring 41 as an urging member is inserted between the flange member 40 and the support base 35. The restriction pin 37 is elastically urged downward by the spring 41.

The restriction pin 37 has a position detection stick 44. The support base 35 has a plate 45. The position detection stick 44 of the restriction pin 37 passes through a slot 46, which is formed vertically and elongated on the plate 45, to protrude toward the front side.

At the front portion of the plate 45, there are arranged a couple of optical sensors 48*a* and 48*b* as position-detecting means, which are lined up vertically along the slot 46. The position of the position detection stick 44 or the position of the restriction pin 37 is detected by these optical sensors 48*a* and 48*b*.

The hangers 11*a* and 11*b* arranged on the respective door panels 4*a* and 4*b* have limit plates 50*a* and 50*b*, respectively. These limit plates 50*a* and 50*b* protrude toward the front side of the car 1, and are arranged with their positions made different from each other along the vertical direction.

Figure 2:
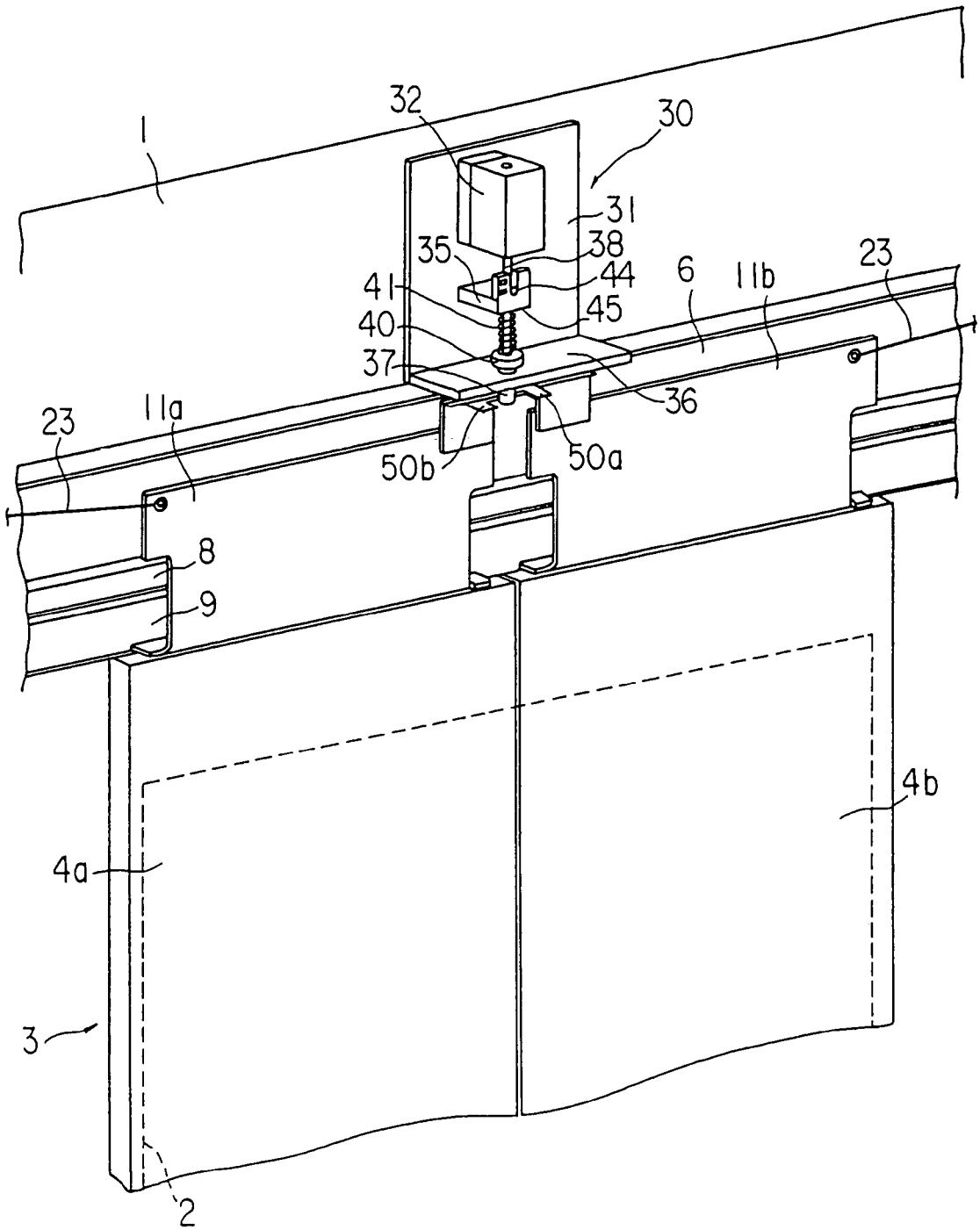
FIG. 2 is a perspective view of the upper portion of the car door apparatus of the elevator of the first embodiment according to the present invention.
Figure 4:
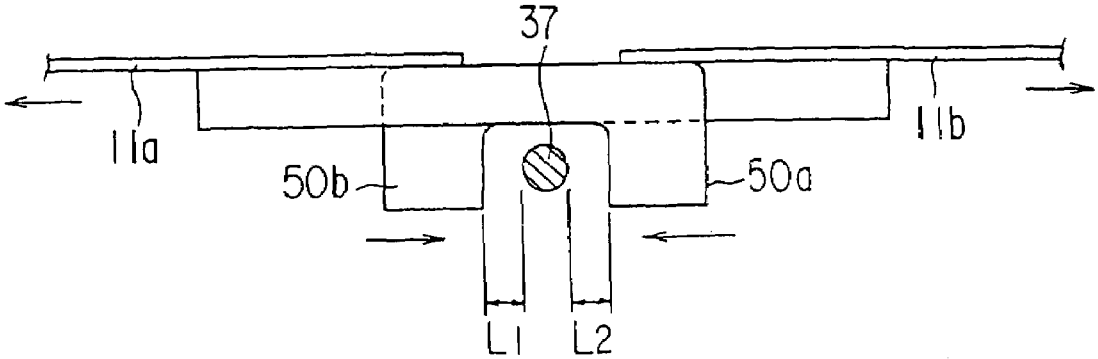
FIG. 4 is a sectional view along an A—A line shown in FIG. 3.

In the closed state in which the edges of the door panels 4*a* and 4*b* are made to abut on each other, as shown in FIGS. 1A and 2, the limit plate 50*a* of the one door panel 4*a* extends toward the arrangement side of the other door panel 4*b*, while the limit plate 50*b* of the other door panel 4*b* extends toward the arrangement side of the one door panel 4*a*, as shown in FIG. 4. Accordingly, at the time of opening state when the door panels 4*a* and 4*b* are drawn away from each other, as shown by arrows in FIG. 4, the one limit plate 50*a* and the other limit plate 50*b* are moved to approach each other.

Then, after being moved by a predetermined distance and the one limit plate 50*a* and the other limit plate 50*b* passes each other, the one limit plate 50*a* and the other limit plate 50*b* are left away from each other.

The restriction pin 37 generally protrudes downward greatly under the edge plate 36, and is stuck into the space between the limit plate 50*a* of the one door panel 4*a* and the limit plate 50*b* of the other door panel 4*b* in the closed state. At this time, distance $L_1$ between the restriction pin 37 and the side edge of the one limit plate 50*a* and distance $L_2$ between the restriction pin 37 and the side edge of the other limit plate 50*b* each is, for example, 50 millimeters respectively.

Next, the operation will be explained.

When the elevator is generally running, as shown in FIG. 1A, the doorway 2 of the car 1 is shut by the door panels 4*a* and 4*b*. The electromagnetic actuator 32 of the limiting device 30 is not supplied with power. The restriction pin 37 is urged downward by its own weight and urging force of the spring 41, and is stuck into the space between the limit plate 50*a* of the one door panel 4*a* and the limit plate 50*b* of the other door panel 4*b* in the closed state, as shown in FIGS. 2 to 5. At this time, the position of the restriction pin 37 is recognized when the position detection stick 44 is detected by the optical sensor 48*b*.

When the car 1 gets into a predetermined landing-zone, the electromagnetic actuator 32 comes to be supplied with power. When the electromagnetic actuator 32 is supplied with power, the plunger 38 is attracted upward due to electromagnetic force. Then, the restriction pin 37 is drawn upward together with the plunger 38, and gets away from the space between the limit plate 50*a* and the limit plate 50*b*, coming to be in the released state. At this time, the position of the restriction pin 37 is recognized when the position detection stick 44 is detected by the optical sensor 48*a*.

When the car 1 lands on a destination floor, as shown in FIG. 1B, the door panels 4*a* and 4*b* are driven to slide rightward and leftward by the door drive device 5, and the doorway 2 of the car 1 is opened. The door panels 4*a* and 4*b* are driven by the door drive device 5 to close the doorway 2 after passengers get on and get off the car 1. The power supplied to the electromagnetic actuator 32 is shut when the door panels 4*a* and 4*b* have been closed. Then, the restriction pin 37 is descent by its own weight and urging force of the spring 41 together with the plunger 38, and is stuck into the space between the limit plates 50*a* and 50*b* of the door panels 4*a* and 4*b*. Then, the closed state of the door panels 4*a* and 4*b* is maintained, and services of the car 1 are restarted under this state.

On the other hand, when the power source 15 for driving the elevator is shut off due to electric power failure, etc. and the car 1 is stopped in emergency in case the car 1 is running, the power supply line for the door drive device 5 is automatically switched to that of the secondary battery 16 for an emergency power source.

The door drive device 5 is started up by electric power from the secondary battery 16, and the door panels 4*a* and 4*b* are slid in the direction of opening the door. As a result, there appears a clearance between the edges of the door panels 4*a* and 4*b*.

When the door panels 4*a* and 4*b* are drawn away from each other in the opening direction by approximately 40 millimeters respectively, the each hanger rollers 12*a*, 12*b*, 13*a* and 13*b* arrive at the slopes 18*a* of the door rails 8 and 9.

At this time, it is necessary to apply a force F to the each hanger rollers 12*a*, 12*b*, 13*a* and 13*b* to climb over the slopes 18*a* against the gravitation. However, a driving force of the door drive device 5 that is started up by the secondary battery 16 as a power source is set to be smaller than the force F in advance. Hence, the door panels 4*a* and 4*b* are slid in the opening direction by approximately 40 millimeters respectively, when the each hanger rollers 12*a*, 12*b*, 13*a* and 13*b* arrive at the slopes 18*a*, and stop to keep a clearance of approximately 80 millimeters made therebetween.

When the car 1 is stopped in an emergency during the running of car 1, in a case the power source is shut off because an electric power failure, etc. has occurred, the door panels 4*a* and 4*b* are automatically moved by a predetermined distance (40 millimeters) respectively, and a predetermined clearance (80 millimeters) is made between the door panels 4*a* and 4*b*. Thus, air in the car 1 and ambient air circulate sufficiently through the clearance. Accordingly, air ventilation will be properly performed, and deficiency of oxygen never occurs in the car 1. Hence passengers in the car 1 will not feel uncomfortable.

Furthermore, since a clearance of a predetermined width is made between the door panels 4*a* and 4*b*, passengers in the car 1 can realize conditions outside the elevator through the clearance. The scary feeling such as confined in a closed room of the passengers is softened.

On the other hand, when passengers in the car 1 try to break the door panels 4*a* and 4*b* open by putting in their hands into the clearance, the movement of door panels 4*a* and 4*b* are restricted by about 10 millimeters in the opening direction, the limit plates 50*a* and 50*b* abut on the restriction pin 37 and further sliding is limited. Therefore, the clearance formed between the door panels 4*a* and 4*b* is limited to be less than 100 millimeters, and clearance is not opened widely. The car 1 can secure safety without exposing inside passengers to the danger of falling down from the clearance.

Furthermore, the limit plates 50*a* and 50*b* of the door panels 4*a* and 4*b* abut on the restriction pin 37 and further shifting is restrained when a driving force exceeding the force F is generated by the door drive device 5, and the door panels 4*a* and 4*b* further move in the opening direction causing the each hanger rollers 12*a*, 12*b*, 13*a* and 13*b* are made to climb over the slopes 18*a* by the driving force. Therefore, the door panels 4*a* and 4*b* are prevented from being opened widely. Hence, passengers in the car 1 are not exposed to the danger of falling down through the clearance, thereby assuring safety.

In case the door panels 4*a* and 4*b* cannot be opened due to failure of the secondary battery 16 at the time when the car 1 is stopped in emergency, it is possible to make an announcement that prompts passengers in the car 1 to open the door panels 4*a* and 4*b* manually using a voice announcement device driven by another secondary battery.

Figure 6A:
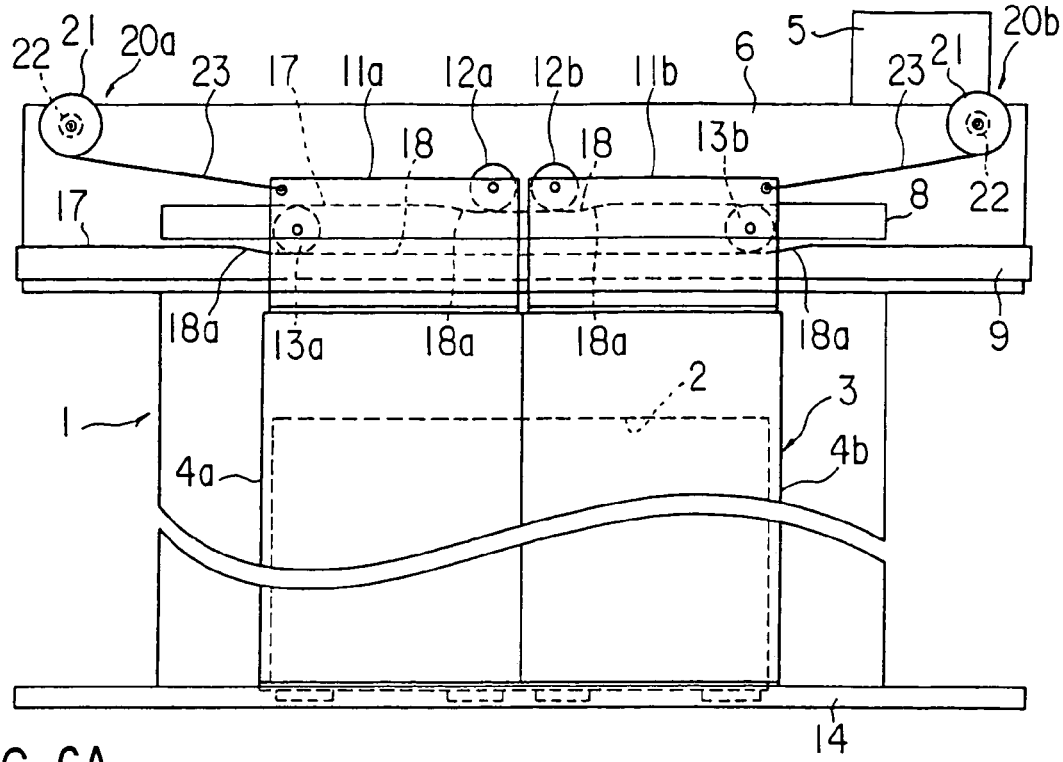
FIG. 6A is a front view of a car door apparatus of an elevator of the second embodiment according to the present invention that is viewed from the elevator hall side, in which the car door apparatus is closed.
Figure 6B:
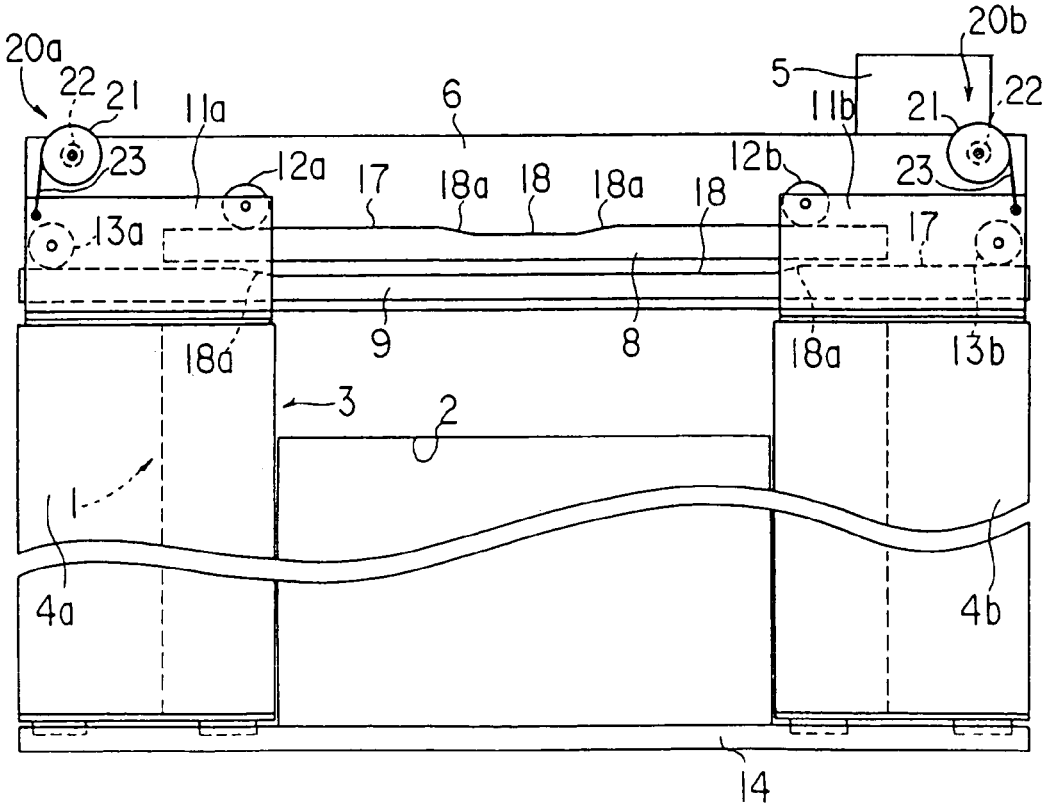
FIG. 6B is a front view of the car door apparatus shown in FIG. 6A, in which the car door apparatus is opened.

The second embodiment is shown in FIGS. 6A and 6B. In the second embodiment, an ordinary power source alone is connected to the door drive device 5, and an emergency power source is not connected thereto.

There are arranged winding devices 20*a* and 20*b* as an urging mechanism on both sides of the support plate 6. Each of the winding devices 20*a* and 20*b* includes a reel 21, a spring 22, and a wire member 23. The reel 21 is rotatably attached to the support plate 6. The spring 22 elastically urges the reel 21 in one rotation direction. The wire member 23 is a wire that has one end wound around the reel 21, and the other end connected to the hanger 11*a* or 11*b* of the door panel 4*a* or 4*b*.

The door panels 4*a* and 4*b* are elastically urged by the elastic force of the springs 22 through the wire members 23 in the direction of drawing away from each other or the opening direction. The urging force can slide the door panels 4*a* and 4*b* in the closed state in the opening direction in the range of the recesses 18, and is set to be smaller than the force required when the each hanger rollers 12*a*, 12*b*, 13*a* and 13*b* climb over the slopes 18*a* of the door rails 8 and 9.

When a predetermined electric signal is input, the door drive device 5 that drives the door panels 4*a* and 4*b* moves the door panels 4*a* and 4*b*, which are in the closed state, to open the doorway in the direction of drawing away from each other using electric power, and moves the door panels 4*a* and 4*b*, which are in the opened state, to close the doorway in the direction of approaching each other against the urging force of the winding devices 20*a* and 20*b*. The door panels 4*a* and 4*b*, which are in the closed state, are kept in that state by being restricted from moving when the power is supplied to the door drive device 5, and the door panels 4*a* and 4*b* are released from the restricted condition when power supplied to the door drive device 5 is shut off.

The car door device 3 in this embodiment is also provided with the limiting device 30 similar to that shown in FIGS. 2 to 5. Therefore the operation will be explained with reference to FIGS. 2 to 5.

Figure 3:
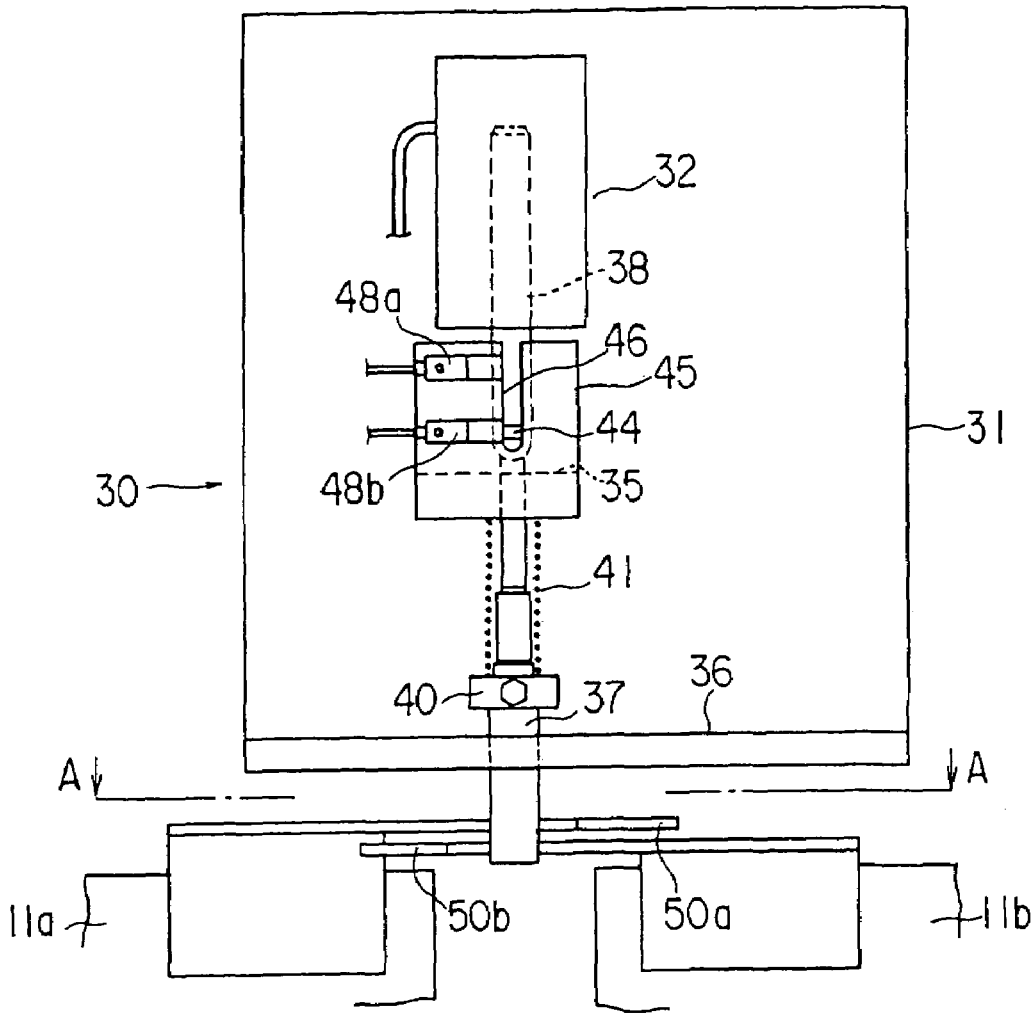
FIG. 3 is a front view of a limiting device shown in FIG. 2.
Figure 5:
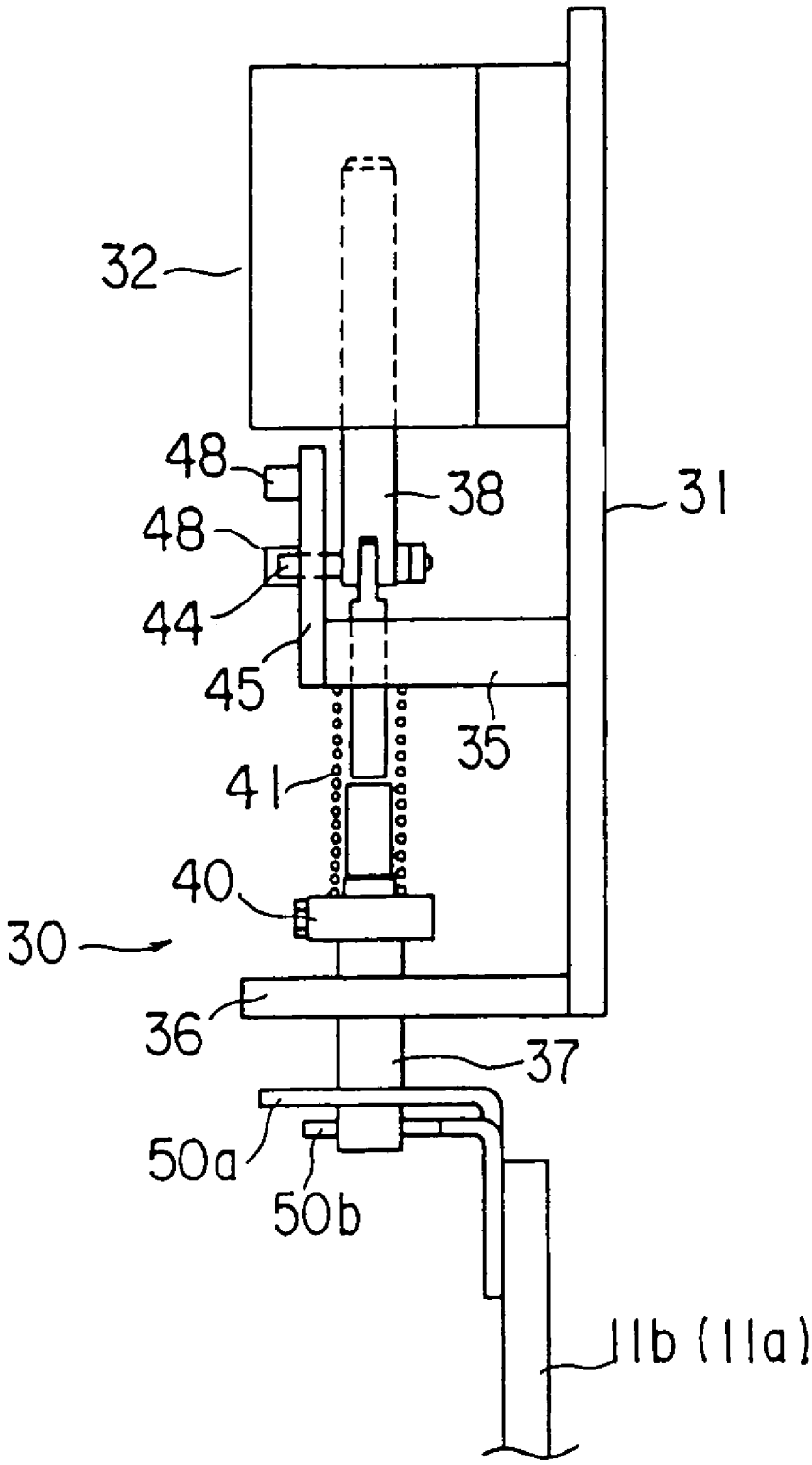
FIG. 5 is a side view of the limiting device shown in FIG. 2.

In the normal service of the elevator, as shown in FIG. 6A, the doorway 2 of the car 1 is shut by the door panels 4*a* and 4*b*. The electromagnetic actuator 32 of the limiting device 30 is not supplied with power. The restriction pin 37 is descent by its own weight and urging force of the spring 41, and is stuck into the space between the limit plate 50*a* of the one door panel 4*a* and the limit plate 50*b* of the other door panel 4*b* in the closed state, as shown in FIGS. 3 to 5. At this time, the position of the restriction pin 37 is recognized when the position detection stick 44 is detected by the optical sensor 48*b*.

The electromagnetic actuator 32 comes to be supplied with power when the car 1, which is running, enters into a predetermined landing-zone. The plunger 38 is attracted upward due to electromagnetic force by supplying the power to the electromagnetic actuator 32. Then, the restriction pin 37 is pulled upward together with the plunger 38, and is withdrawn away from the space between the limit plate 50*a* and the limit plate 50*b*. As a result, the limiting device 30 comes to be in the released state. At this time, the position of the restriction pin 37 is recognized when the position detection stick 44 is detected by the optical sensor 48*a*.

When the car 1 lands on a destination floor, the door panels 4*a* and 4*b* are so driven as to draw rightward and leftward by the door drive device 5, and the doorway 2 of the car 1 is opened, as shown in FIG. 6B. The door panels 4*a* and 4*b* are driven again by the door drive device 5 to close the doorway 2, after passengers have gotten on and get off the car 1. The electromagnetic actuator 32 is stopped the power supplying, after the closing operation. The restriction pin 37 is descent by its own weight and urging force of the spring 41 together with the plunger 38, and is stuck into the space between the limit plates 50*a* and 50*b* of the door panels 4*a* and 4*b*. Consequently, the car 1 is maintained the closed state of the door panels 4*a* and 4*b*, and resumes the service under this state.

The wire members 23 of the winding devices 20*a* and 20*b* are wound by the reels 21 due to the urging force of the springs 22 when the door panels 4*a* and 4*b* move in the opening direction, and are reeled out from the reels 21 against the urging force of the springs 22 when the door panels 4*a* and 4*b* move in the closing direction.

On the other hand, when the car 1 is stopped from running in an emergency stopping power supply due to an electric power failure, the door panels 4*a* and 4*b* which are held by the door drive device 5 are also released.

The door panels 4*a* and 4*b* are elastically urged by the winding devices 20*a* and 20*b* to open the doorway in the direction of drawing away from each other. When the restriction by the door drive device 5 is released, the door panels 4*a* and 4*b* are moved in the opening direction due to the urging force of the winding devices 20*a* and 20*b* accordingly, and a clearance is appeared between the edges of door panels 4*a* and 4*b*.

The respective hanger rollers 12*a*, 12*b*, 13*a* and 13*b* arrive at the slopes 18*a* of the door rails 8 and 9, when the door panels 4*a* and 4*b* are drawn away from each other in the opening direction by approximately 40 millimeters respectively.

At this time, it is necessary to apply a force F to the respective hanger rollers 12*a*, 12*b*, 13*a* and 13*b* to climb over the slopes 18*a* against the gravitation. However, an elastic urging force by the winding devices 20*a* and 20*b* is set to be smaller than the force F in advance. Therefore, the door panels 4*a* and 4*b* are moved in the opening direction by approximately 40 millimeters respectively, and are stopped by causing the respective hanger rollers 12*a*, 12*b*, 13*a* and 13*b* are arrived at the slopes 18*a* when a clearance is made of approximately 80 millimeters between the door panels 4*a* and 4*b*.

The door panels 4*a* and 4*b* are automatically opened by a predetermined distance, 40 millimeters respectively, and make a clearance, 80 millimeters therebetween, when the power supplying is stopped because of an electrical power failure occurring in a running state of the car 1, and the car 1 is stopped in an emergency. Thus, air in the car 1 and external air circulate sufficiently through the clearance. Therefore, air ventilation in the car 1 is properly executed, and deficiency of oxygen never occurs in the car 1. Thus passengers in the car 1 do not feel uncomfortable.

Furthermore, since a clearance of a predetermined width appears between the door panels 4*a* and 4*b*, passengers in the car 1 can see the condition outside the elevator through the clearance. Therefore the passengers will be liberated from a scary feeling of being confined in a closed chamber.

On the other hand, when passengers in the car 1 try to break the door panels 4*a* and 4*b* open by putting their hands into the clearance, the door panels 4*a* and 4*b* are moved in the opening direction by approximately 10 millimeters, and are limited from moving by the limit plates 50*a* and 50*b* of the door panels 4*a* and 4*b* interfering with the restriction pin 37. Accordingly, the clearance formed between the door panels 4*a* and 4*b* is restricted to the width of 100 millimeters, and the door panels 4*a* and 4*b* do not open widely. Passengers in the car 1 are secured against the danger of falling down through the clearance.

The force for sliding the door panels 4*a* and 4*b* horizontally by the winding devices 20*a* and 20*b* in the opening direction is changed depending on the angle of the wire member 23 against the level line. That is, the component of force in the horizontal direction to move the door panels 4*a* and 4*b* is large when the angle of the wire member 23 against the level line is shallow, and the horizontal force component to move the door panels 4*a* and 4*b* becomes small as the angle of the wire member 23 against the level line becomes steep.

The angle of the wire member 23 of the winding devices 20*a* and 20*b* against the level line is shallow when the door panels 4*a* and 4*b* are in the closed state, and is made steep gradually when the door panels 4*a* and 4*b* move in the opening direction.

Accordingly, the door panels 4*a* and 4*b* receive a large horizontal force component at the beginning of opening, and surely start the operation of opening the door. When the door panels 4*a* and 4*b* move in the opening direction, the horizontal force component becomes small gradually. Thus, the door panels 4*a* and 4*b* surely stop when the respective hanger rollers 12*a*, 12*b*, 13*a* and 13*b* reach the slopes 18*a* of the door rails 8 and 9.

Figure 7A:
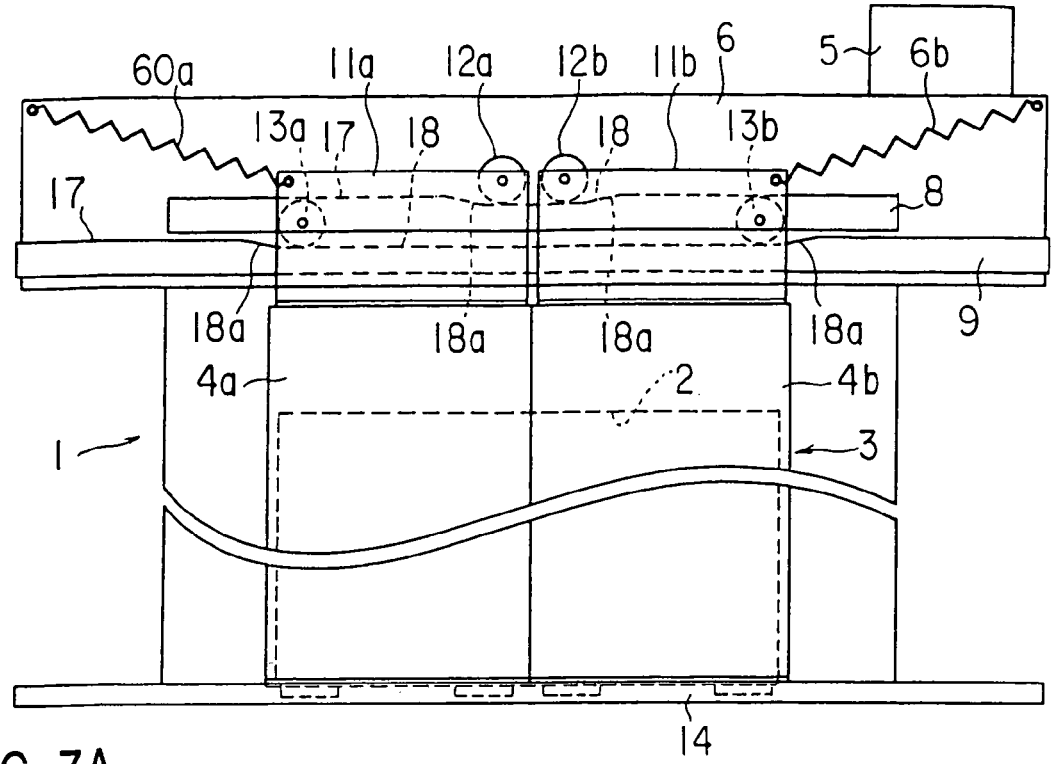
FIG. 7A is a front view of a car door apparatus of an elevator of the third embodiment according to the present invention that is viewed from the elevator hall side, in which the car door apparatus is closed.
Figure 7B:
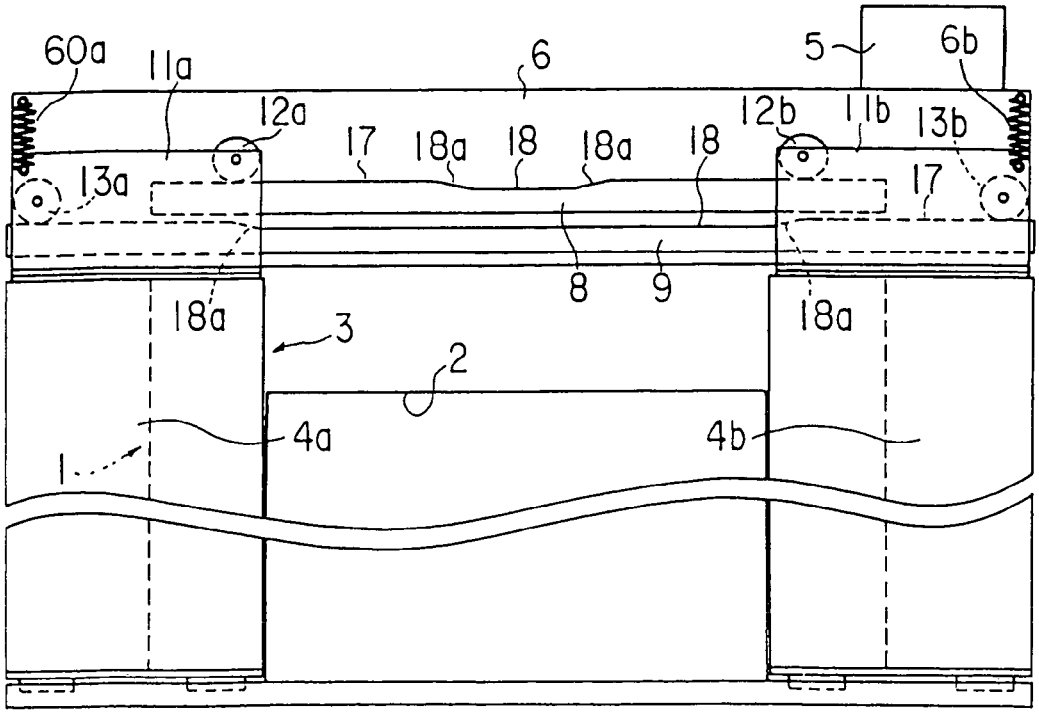
FIG. 7B is a front view of the car door apparatus shown in FIG. 7A, in which the car door apparatus is opened.

The third embodiment is shown in FIGS. 7A and 7B. In the third embodiment, as a urging mechanism to move the door panels 4*a* and 4*b* in the closed state in the opening direction by a predetermined distance when power supply to the door drive device 5 is shut off, tension springs 60*a* and 60*b* are used.

The tension springs 60*a* and 60*b* have one ends hooked to the support plate 6 attached to the front portion of the car 1, and have the other ends hooked to the hangers 11*a* and 11*b*. The door panels 4*a* and 4*b* are elastically urged to be opened by the elastic force of the tension springs 60*a* and 60*b* in the direction of drawing away from each other. The urging force can move the door panels 4*a* and 4*b* in the closed state in the opening direction in the range of the recesses 18, and is set to be smaller than the force required when the respective hanger rollers 12*a*, 12*b*, 13*a* and 13*b* climb over the slopes 18*a* of the door rails 8 and 9.

Accordingly, in the third embodiment, an effect similar to that of the second embodiment can be obtained.

Figure 8A:
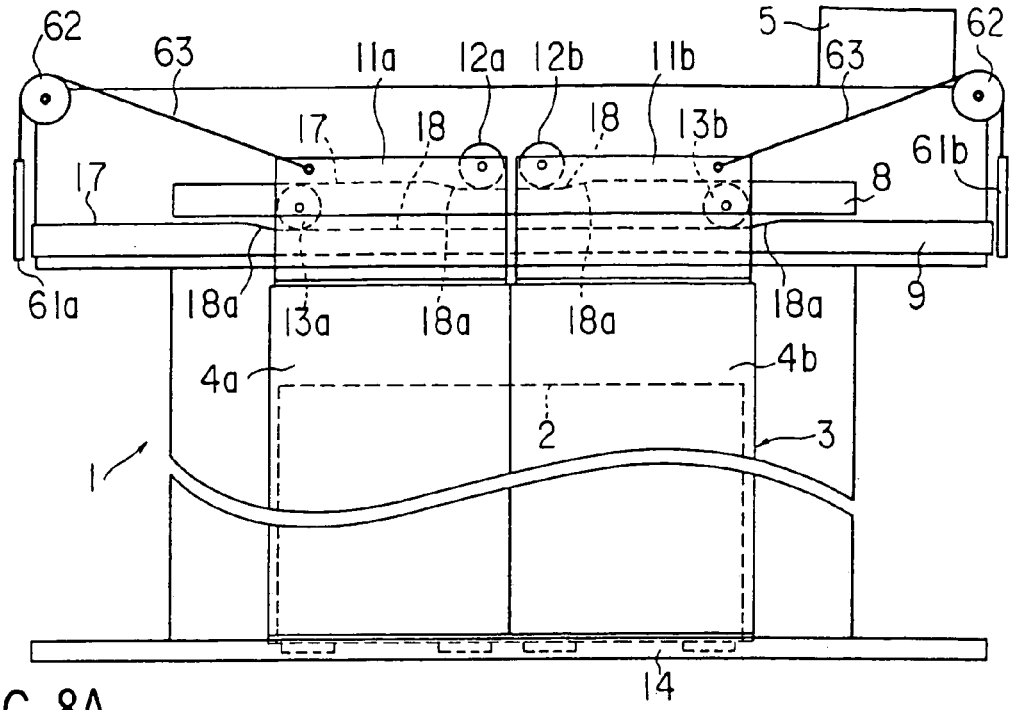
FIG. 8A is a front view of a car door apparatus of an elevator of the fourth embodiment according to the present invention that is viewed from the elevator hall side, in which the car door apparatus is closed.
Figure 8B:
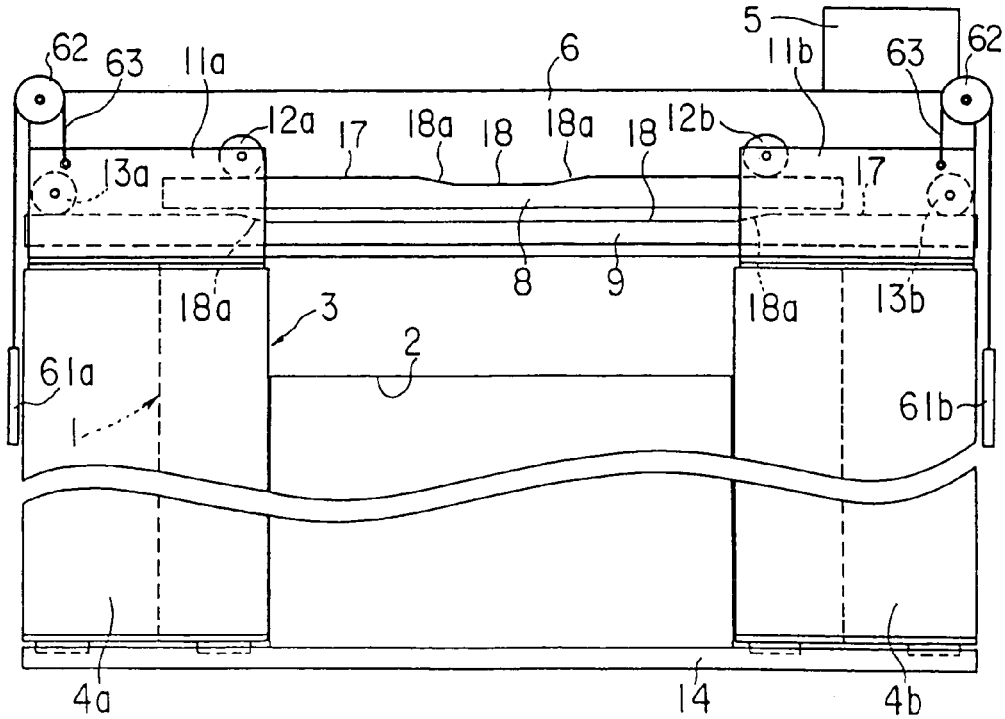
FIG. 8B is a front view of the car door apparatus shown in FIG. 8A, in which the car door apparatus is opened.

The fourth embodiment is shown in FIGS. 8A and 8B. In the fourth embodiment, weights 61*a* and 61*b* are used as an urging mechanism to move the door panels 4*a* and 4*b* in the closed state in the opening direction by a predetermined distance when power supply to the door drive device 5 is shut off.

There are rotatably arranged pulleys 62 on both sides of the support plate 6 attached to the front portion of the car 1 respectively.

Wire members 63 such as wires are wound around these pulleys 62. One ends of the wire members 63 are fastened to the hangers 11*a* and 11*b* of the door panels 4*a* and 4*b*. Other ends of the wire members 63 are fixed to the weights 61*a* and 61*b*. The door panels 4*a* and 4*b* are urged by the gravitation of the weights 61*a* and 61*b* to be opened in the direction of drawing away from each other.

The urging force can move the door panels 4*a* and 4*b* in the closed state in the opening direction in the range of the recesses 18, and is set to be smaller than the force required when the respective hanger rollers 12*a*, 12*b*, 13*a* and 13*b* climb over the slopes 18*a* of the door rails 8 and 9.

Accordingly, in the third embodiment, an effect similar to that of the second embodiment can be obtained.

In each case of above-described embodiments, when considering the condition of properly carrying out air ventilation in the car 1 and securing safety of passengers, it is desirable that the width of a clearance formed between the door panels 4*a* and 4*b* when the car 1 is stopped in emergency be in the range between 50 to 200 millimeters.

According to the present invention as has been described hereinbefore, door panels of a car can be automatically opened within a predetermined range assuring safety to ventilate in the car when the car is stopped in an emergency, because a power source for driving an elevator is shut off due to an electric power failure, etc.

Accordingly, in the third embodiment, an effect similar to that of the second embodiment can be obtained.

In each case of above-described embodiments, when considering the condition of properly carrying out air ventilation in the car 1 and securing safety of passengers, it is desirable that the width of a clearance formed between the door panels 4*a* and 4*b* when the car 1 is stopped in emergency be in the range between 50 to 200 millimeters.

According to the present invention as has been described hereinbefore, door panels of a car can be automatically opened within a predetermined range assuring safety to ventilate in the car when the car is stopped in an emergency, because a power source for driving an elevator is shut off due to an electric power failure, etc.

What is claimed is:

1. A car door apparatus of an elevator, comprising:

a pair of door panels that open and close a doorway of a car of the elevator;

a door drive device that drives the door panels to open and close the doorway by using electric power; and a door-opening mechanism that starts up the door drive device by using a secondary battery to move the door panels in the opening direction by a predetermined distance respectively to make a predetermined clearance between the door panels when the car is stopped in an emergency causing the electric power for driving the elevator to be shut off, wherein:

the door panels move along door rails provided at the car, said door rails have lower steps and upper steps divided by slopes, said lower steps are formed at the middle portion of the door rails, and said door panels in the closed state climb over the slopes to move from the lower step areas to the upper step areas to open the doorway, and the door-opening mechanism generates a driving force to move the door panels, said driving force being set to be smaller than a climbing force that is required to make the door panels climb over the slopes.

2. The car door apparatus of the elevator according to claim 1, wherein the predetermined clearance is set in a range between 50 to 200 millimeters.

3. The car door apparatus of the elevator according to claim 1, further comprising:

a limiting device that limits the door panels to move further in the opening direction when the door panels are moved in the opening direction by a predetermined distance respectively by the door-opening mechanism.

4. The car door apparatus of the elevator according to claim 3, wherein the limiting device is provided with a restriction pin that can move vertically, an electromagnetic actuator that drives the restriction pin, and an urging member that urges the restriction pin downward, further wherein said restriction pin is attracted upward when the electromagnetic actuator is supplied with power, and descends by its own weight and an urging force of the urging member when the electromagnetic actuator is not supplied with power to limit a moving range of the door panels at this lower position.

5. The car door apparatus of the elevator according to claim 4, wherein the restriction pin is held in the upper position to release the door panels, which is limited to move, by supplying power to the electromagnetic actuator of the limiting device when the door panels are driven by the door drive device.

6. The car door apparatus of the elevator according to claim 4, wherein the limiting device includes a position-detecting means for detecting the position of the restriction pin.

7. A car door apparatus of the elevator comprising:

a door panel that opens and closes a doorway of a car of the elevator;

a door rail that slidably suspends said door panel and has a lower step and an upper step divided by a slope;

a door drive device that controls said door panel to open and close the doorway when the power is supplied, and releases to make said door panel slide freely when the power is shut off; and a door-opening mechanism that includes an urging mechanism that urges said door panel in the opening direction by an urging force that moves said door panel in a range of the lower step of said door rail, said urging force being set to be smaller than a climbing force that is required to make the door panel climb over the slope.

8. The car door apparatus of the elevator according to claim 7, wherein the urging mechanism comprises:

a winding device having a reel which is rotatably attached above the door panel;

a wire member which has one end wound around the reel and the other end connected to the top of the door panel; and a spring which rolls up the wire member to rotate the reel.

9. The car door apparatus of the elevator according to claim 7, wherein the urging mechanism comprises:

a tension spring which generates the urging force, said tension spring having one end hooked above the door panel and the other end hooked to the top portion of the door panel.

10. The car door apparatus of the elevator according to claim 7, wherein the urging mechanism comprises:

a pulley which is rotatably attached above the door panel;

a wire member which is wound around said pulley and has one end fastened to the top of the door panel; and a weight which generates said urging force by connecting the other end of the wire member.

* * * * *